US010869130B2

(12) United States Patent
Chen

(10) Patent No.: US 10,869,130 B2
(45) Date of Patent: Dec. 15, 2020

(54) DIAPHRAGM AND LOUDSPEAKER

(71) Applicant: AAC Technologies Pte. Ltd., Singapore (SG)

(72) Inventor: Hao Chen, Shenzhen (CN)

(73) Assignee: AAC Technologies Pte. Ltd., Singapore (SG)

( * ) Notice: Subject to any disclaimer, the term of this patent is extended or adjusted under 35 U.S.C. 154(b) by 0 days.

(21) Appl. No.: 16/438,475

(22) Filed: Jun. 12, 2019

(65) Prior Publication Data

US 2019/0387323 A1 Dec. 19, 2019

(30) Foreign Application Priority Data

Jun. 15, 2018 (CN) ..... 2018 2 0940478 U

(51) Int. Cl.
*H04R 7/14* (2006.01)
*H04R 7/18* (2006.01)

(52) U.S. Cl.
CPC ..... *H04R 7/14* (2013.01); *H04R 7/18* (2013.01)

(58) Field of Classification Search
CPC ..... H04R 7/14; H04R 7/18
USPC ..... 381/398
See application file for complete search history.

(56) References Cited

U.S. PATENT DOCUMENTS

| | | | | |
|---|---|---|---|---|
| 7,866,439 | B2 * | 1/2011 | Windischberger | H04R 7/20 181/157 |
| D656,920 | S * | 4/2012 | Chen | D14/214 |
| D656,921 | S * | 4/2012 | Chen | D14/214 |
| 9,510,087 | B2 * | 11/2016 | Cai | H04R 9/06 |
| 10,382,868 | B2 * | 8/2019 | Wu | H04R 31/003 |
| 2003/0194104 | A1 * | 10/2003 | Irby | H04R 7/122 381/398 |
| 2014/0318885 | A1 * | 10/2014 | Kim | H04R 7/02 181/171 |
| 2018/0213330 | A1 * | 7/2018 | Hou | H04R 7/18 |
| 2019/0082262 | A1 * | 3/2019 | Ilkorur | H04R 7/18 |

* cited by examiner

*Primary Examiner* — Sean H Nguyen
(74) *Attorney, Agent, or Firm* — W&G Law Group LLP

(57) ABSTRACT

Disclosed are a diaphragm and a loudspeaker using the diaphragm. The diaphragm comprises an edge, a fixing section formed by the edge's outer edge extending outward, and an intermediate section formed by the edge's inner edge extending inward, wherein the edge is disposed with a plurality of stiffeners extending from the edge and across the edge's inner edge to the intermediate section. The loudspeaker includes the diaphragm. The stiffeners disposed on the edge extend to the intermediate section, which increases strength of the inner of the edge, especially of the curved sections. In this way, strength of the edge and stability and pure tone matters of the diaphragm during practical applications may be improved.

18 Claims, 2 Drawing Sheets

DIAPHRAGM AND LOUDSPEAKER

TECHNICAL FIELD

The present disclosure relates to loudspeaker parts, and particularly relates to a diaphragm and a loudspeaker using the diaphragm.

BACKGROUND

With the rapid development of electronic information technology, loudspeaker devices are widely used in various electronic products, especially in mobile communication equipment that is most widely used. Not only miniaturization and multi-function are required, but higher requirements are put on quality, distortion and stability of sound effect. A typical loudspeaker includes a vibrating system, a magnetic circuit system and a protective casing. The vibrating system includes a voice coil suspended in a magnetic gap and a diaphragm that is connected to and driven by the voice coil to vibrate. As a core part of a loudspeaker device, the design of the diaphragm directly affects performance of an acoustic device.

A diaphragm in the related art includes an edge, a fixing section formed by the edge's outer edge extending outward, and an intermediate section formed by the edge's inner edge extending inward. The edge is disposed with a plurality of stiffeners. Conventional stiffeners extend along the edge's outer edge to the edge's inner edge, and space from the edge's outer edge and the edge's inner edge. Such a structure usually results in weak strength of the edge, especially weak strength at a curved section of the edge, which can easily be broken and is not advantageous for keeping balance while the diaphragm is vibrating, thus affecting pure tone and performance of the loudspeaker.

Therefore, it is necessary to provide a new type of diaphragm and a loudspeaker using the diaphragm, and increase strength of the inner side of the edge to improve the pure tone and stability matters.

SUMMARY

The purpose of the present disclosure is to provide a diaphragm with increased inner strength of an edge and improved vibration stability, distortion and strength, in regard to the above-described problems existing in the existing technology.

The purpose of the present disclosure may be realized by the following technical solution: a diaphragm including an edge, a fixing section formed by the edge's outer edge extending outward, and an intermediate section formed by the edge's inner edge extending inward, wherein the edge is disposed with a plurality of first stiffeners extending from the edge and across the edge's inner edge to the intermediate section.

Preferably, the first stiffeners are symmetrical relative to a center of the diaphragm.

Preferably, distances between two neighboring first stiffeners gradually increase from the intermediate section to the fixing section.

Preferably, the first stiffeners protrude in the same direction as the edge.

Preferably, a through hole is disposed through the intermediate section, the diaphragm further includes a strengthening plate attached to the intermediate section and covering the through hole, and the first stiffeners extend to a fringe of the strengthening plate.

Preferably, the edge includes two long sides disposed opposite to each other, two short sides disposed opposite to each other, and curved sections connecting neighboring long side and short side, the first stiffeners are located on the curved sections.

Preferably, each curved section has an equal number of first stiffeners, any first stiffeners on the same curved section symmetrical relative to the center of the curved sections where these first stiffeners locate.

Preferably, a plurality of second stiffeners and third stiffeners of the same number as the second stiffeners are disposed on the long sides and/or the short sides of the edge, and all the second stiffeners and all the third stiffeners are curved, the second stiffeners are bended in a direction opposite to a direction of the third stiffeners.

Preferably, the second stiffeners are disposed symmetrical to the third stiffeners, relative to a center of the side where the second stiffeners and the third stiffeners are located.

Preferably, the present disclosure further provides a loudspeaker including the diaphragm as described above.

The stiffeners disposed on the edge of the diaphragm extend to the intermediate section, which increases strength of the inner of the edge, especially of the curved sections. In this way, poor strength of the edge and stability and pure tone matters during practical applications may be improved.

DETAILED DESCRIPTION

The following are specific embodiments of the present disclosure, which further describe the technical solution of the present disclosure with reference to the accompanying drawings, but the present disclosure is not limited to the embodiments.

Figure 1:
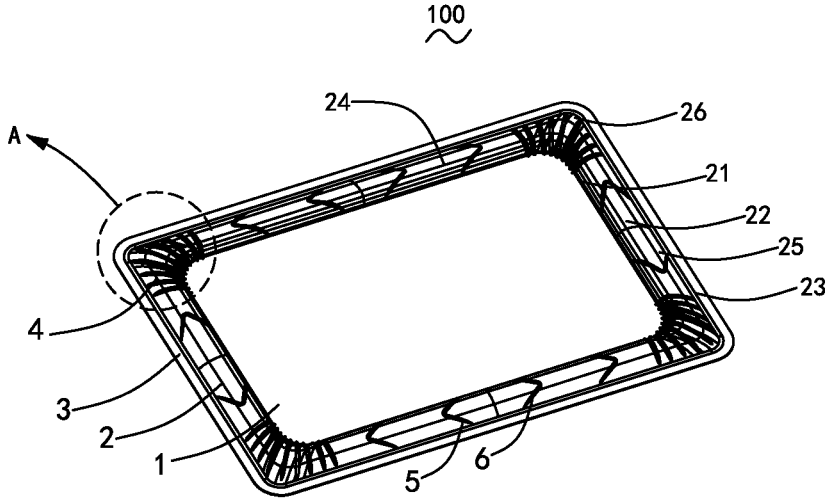
FIG. 1 is a schematic perspective view of a diaphragm provided by the present disclosure.
Figure 2:
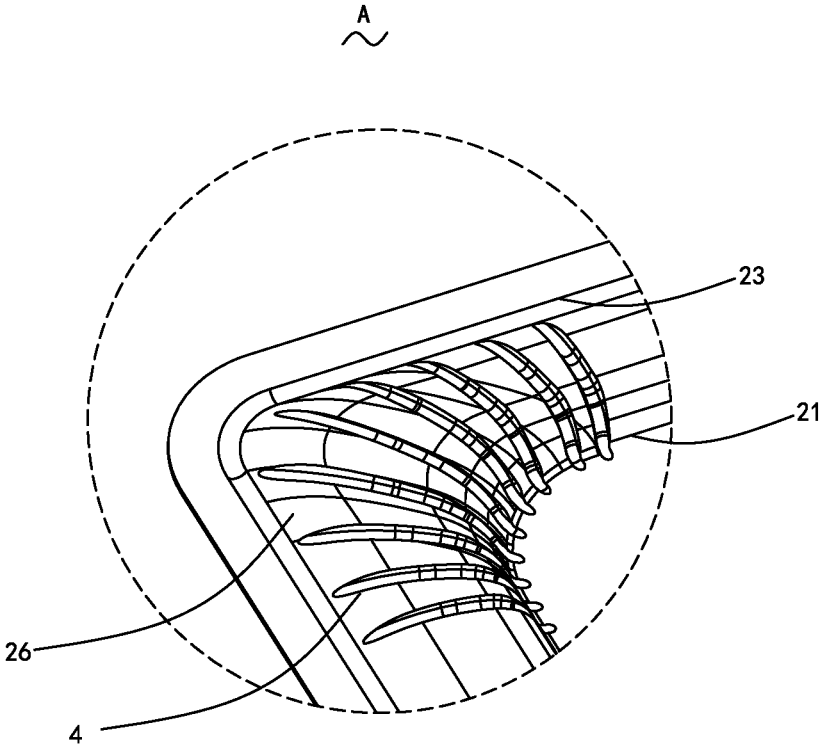
FIG. 2 is a partially zoomed-in view of area A in FIG. 1.

As shown in FIG. 1, the diaphragm 100 provided by the present disclosure includes an intermediate section 1, an edge 2 disposed around the outside of the intermediate section 1, and a fixing section 3 disposed around the outside of the edge 2. The edge 2 includes an inner edge 21, an intermediate connecting section 22, and an outer edge 23. It is seen from the angle of view in FIG. 1, the intermediate section 1, the edge 2 and the fixing section 3 form a substantially rectangular diaphragm. The diaphragm may otherwise be of a shape other than a rectangle, for example, a circle or an ellipse.

Specifically, the intermediate section 1 may be a flat-plate structure, or may be an arched structure that protrudes up or down and with curved cross sections, or may be disposed with a through hole through the intermediate section. A strengthening plate is attached to and covers the through hole, and first stiffeners extend to a fringe of the strengthening plate. In this embodiment, the intermediate section 1 is a flat plate structure of a rounded rectangle.

The edge 2 may be disposed as a convexity protruding upward or a concave protruding downward, or a structure with a plurality of convexities or a plurality of concavities, i.e., an edge with multiple sections.

In this embodiment, the edge 2 is a rounded rectangle, including two long sides 24 symmetrically disposed, two short sides 25 symmetrically disposed, and four curved sections 26 connecting neighboring long sides and short sides. A fringe of the edge include an inner edge 21 connected to the inner intermediate section 1 and an outer edge 23 connected to the outer fixing section 3. The intermediate connecting section 22 protrudes upward, and the inner edge 21 and the outer edge 23 are rounded rectangles.

The edge 2 is disposed with a plurality of stiffeners for increasing strength of the edge and improving stability of the diaphragm. Generally, in order to balance vibrating regions of the diaphragm, the stiffeners are symmetrically and evenly distributed on the edge. In this embodiment, the stiffeners include a first stiffener 4, a second stiffener 5 and a third stiffener 6. Distribution of the stiffeners on the edge 2 may be adjusted as needed. The first stiffeners 4 extend from the edge 2 and across the edge's inner edge 21 to the intermediate section 1.

The first stiffeners are symmetrical relative to the center of the diaphragm 100. Distances between two neighboring first stiffeners 4 gradually increase from the intermediate section 1 to the fixing section 3.

Preferably, the first stiffeners 4 may further extend to the fringe of the strengthening plate.

Preferably, the first stiffeners 4 protrude in the same direction as the edge 2. The first stiffeners 4 may otherwise protrude in the opposite direction of that of the edge 2.

Preferably, the edge 2 includes two long sides 24 disposed opposite to each other, two short sides 25 disposed opposite to each other, and curved sections 26 connecting neighboring long and short sides, the first stiffeners 4 are located on the curved sections 26.

Preferably, the first stiffeners 4 are evenly and symmetrically distributed on the four curved sections 26, each curved section 26 has an equal number of first stiffeners 4, and any first stiffeners on the same curved section are symmetrical relative to the center of the curved section where these first stiffeners locate. A particular number may be adjusted according to sizes of the inner and outer curved sections and specific needs.

Preferably, the other ends of the first stiffeners 4 may extend to the outer edge 23 of the edge 2, and the first stiffeners 4 may otherwise be symmetrically disposed at remaining positions of the edge 2.

Conventional stiffeners disposed at the curved sections space from the inner and outer fringes of the edge. That the first stiffeners 4 extend from the edge 2 and across the edge's inner edge 21 to the intermediate section 1 may strengthen the curved sections and improve strength of the curved sections 26, as well as stability and pure tone matters of the diaphragm 100 during practical applications.

In the present embodiment, the second stiffener 5 and the third stiffener 6 are disposed on a long side 24 and/or a short side 25 of the edge 2. Both the second stiffener 5 and the third stiffener 6 are curved and the second stiffener 5 bends in a direction opposite to a direction of the third stiffener 6. The second stiffener is disposed symmetrical to the third stiffener, relative to the center of the side where the second stiffener and the third stiffener are located. The number and shapes of the second stiffeners 5 and the third stiffeners 6 may be adjusted as needed.

The present disclosure further provides a loudspeaker including the diaphragm as described above.

The above-described are only embodiments of the present disclosure. It shall be noted that skilled persons in the related art may make improvements without departing from the concept of the present disclosure. All these improvements fall into the protection scope of the present disclosure.

What is claimed is:

1. A diaphragm comprising:

an edge, a fixing section formed by the edge's outer edge extending outward, and an intermediate section formed by the edge's inner edge extending inward;

wherein the edge is disposed with a plurality of first stiffeners extending from the edge and across the edge's inner edge to the intermediate section.

2. The diaphragm according to claim 1, wherein the first stiffeners are symmetrical relative to a center of the diaphragm.

3. The diaphragm according to claim 1, wherein distances between two neighboring first stiffeners gradually increase from the intermediate section to the fixing section.

4. The diaphragm according to claim 1, wherein the first stiffeners protrude in the same direction as the edge.

5. The diaphragm according to claim 1, wherein a through hole is disposed through the intermediate section, the diaphragm further comprises a strengthening plate attached to the intermediate section and covering the through hole, and the first stiffeners extend to a fringe of the strengthening plate.

6. The diaphragm according to claim 1, wherein the edge comprises:

two long sides disposed opposite to each other, two short sides disposed opposite to each other, and curved sections connecting neighboring long sides and short sides;

wherein the first stiffeners are located on the curved sections.

7. The diaphragm according to claim 6, wherein each curved section has an equal number of first stiffeners, any first stiffeners on the same curved section symmetrical relative to a center of the curved sections where these first stiffeners locate.

8. The diaphragm according to claim 6, wherein a plurality of second stiffeners and third stiffeners of the same number as the second stiffeners are disposed on the long sides and/or the short sides of the edge, and all the second stiffeners and all the third stiffeners are curved, the second stiffeners are bending in a direction opposite to a direction of the third stiffeners.

9. The diaphragm according to claim 8, wherein the second stiffeners are disposed symmetrical to the third stiffeners, relative to a center of the side wherein the second stiffeners and the third stiffeners are located.

10. A loudspeaker comprising a diaphragm, wherein the diaphragm comprises:

an edge, a fixing section formed by the edge's outer edge extending outward, and an intermediate section formed by the edge's inner edge extending inward;

wherein the edge is disposed with a plurality of first stiffeners extending from the edge and across the edge's inner edge to the intermediate section.

11. The loudspeaker according to claim 10, wherein the first stiffeners are symmetrical relative to a center of the diaphragm.

12. The loudspeaker according to claim 10, wherein distances between two neighboring first stiffeners gradually increase from the intermediate section to the fixing section.

13. The loudspeaker according to claim 10, wherein the first stiffeners protrude in the same direction as the edge.

14. The loudspeaker according to claim 10, wherein a through hole is disposed through the intermediate section, the diaphragm further comprises a strengthening plate attached to the intermediate section and covering the through hole, and the first stiffeners extend to a fringe of the strengthening plate.

15. The loudspeaker according to claim 10, wherein the edge comprises:

two long sides disposed opposite to each other, two short sides disposed opposite to each other, and curved sections connecting neighboring long sides and short sides;

wherein the first stiffeners are located on the curved sections.

16. The loudspeaker according to claim 15, wherein each curved section has an equal number of first stiffeners, any first stiffeners on the same curved section symmetrical relative to a center of the curved sections where these first stiffeners locate.

17. The loudspeaker according to claim 15, wherein a plurality of second stiffeners and third stiffeners of the same number as the second stiffeners are disposed on the long sides and/or the short sides of the edge, and all the second stiffeners and all the third stiffeners are curved, the second stiffeners are bending in a direction opposite to a direction of the third stiffeners.

18. The loudspeaker according to claim 17, wherein the second stiffeners are disposed symmetrical to the third stiffeners, relative to a center of the side wherein the second stiffeners and the third stiffeners are located.

* * * * *